US009410735B2

(12) United States Patent
Maas

(10) Patent No.: US 9,410,735 B2
(45) Date of Patent: Aug. 9, 2016

(54) REFRIGERATION APPLIANCE

(71) Applicant: Miele & Cie. KG, Guetersloh (DE)

(72) Inventor: Guenther Maas, Guetersloh (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 14/719,343

(22) Filed: May 22, 2015

(65) Prior Publication Data

US 2015/0338158 A1 Nov. 26, 2015

(30) Foreign Application Priority Data

May 26, 2014 (DE) ..... 10 2014 107 366

(51) Int. Cl.

| | |
|---|---|
| ***A47B 96/04*** | (2006.01) |
| ***F25D 29/00*** | (2006.01) |
| ***F25D 23/04*** | (2006.01) |
| ***F25D 23/02*** | (2006.01) |

(52) U.S. Cl.

CPC ..... *F25D 29/00* (2013.01); *F25D 23/02* (2013.01); *F25D 23/028* (2013.01); *F25D 23/04* (2013.01); *F25D 2600/00* (2013.01); *F25D 2700/02* (2013.01)

(58) Field of Classification Search

CPC ..... H01H 13/183; F25D 23/02; F25D 23/04
USPC ..... 312/401, 405; 200/61.76
See application file for complete search history.

(56) References Cited

U.S. PATENT DOCUMENTS

| | | | | |
|---|---|---|---|---|
| 5,023,413 | A * | 6/1991 | Staples | H01H 13/063 200/295 |
| 2005/0045457 | A1* | 3/2005 | Park | F25D 29/005 200/61.7 |
| 2010/0018240 | A1 | 1/2010 | Hecht et al. | |
| 2010/0307189 | A1 | 12/2010 | Keller et al. | |
| 2011/0016907 | A1 | 1/2011 | Kang et al. | |
| 2014/0268648 | A1 | 9/2014 | Gomes et al. | |

FOREIGN PATENT DOCUMENTS

| | | | |
|---|---|---|---|
| DE | 202005011427 | U1 | 11/2006 |
| DE | 202006014407 | U1 | 1/2008 |
| DE | 102006061083 | A1 | 6/2008 |
| EP | 2710923 | A1 | 3/2014 |
| WO | 2006017863 | A1 | 2/2006 |

OTHER PUBLICATIONS

U.S. Appl. No. 14/719,337, filed May 22, 2015.

* cited by examiner

*Primary Examiner* — Matthew Ing
(74) *Attorney, Agent, or Firm* — Leydig, Voit & Mayer

(57) ABSTRACT

A refrigeration appliance includes a body having an interior sealed by a closeable door by a seal disposed between the door and the body, and at least one control unit for actuating an opening mechanism acting on the door, whose control signal, which triggers the opening of the door, is configured to be generated by at least one sensor cooperating with a plunger, wherein the plunger has a contact surface for engagement of the sensor, and the plunger is supported in a passage of the door or of the body so that it is configured to be movable, together with the sensor engaged against the contact surface, in an axial longitudinal direction of the plunger and against a force of a spring element.

12 Claims, 6 Drawing Sheets

REFRIGERATION APPLIANCE

CROSS-REFERENCE TO PRIOR APPLICATION

Priority is claimed to German Patent Application No. DE 10 2014 107 366.5, filed on May 26, 2014, the entire disclosure of which is hereby incorporated by reference herein.

FIELD

The present invention relates to a refrigeration appliance.

BACKGROUND

Refrigeration devices, such as, for example, refrigerators, freezers or wine storage cabinets, tend to become increasingly large to provide larger storage capacity. Regardless of their use, such refrigeration appliances have a body having an interior for receiving the objects or products to be cooled, and a door attached to the body. Refrigeration appliances always have an elastically deformable seal disposed between the body and the door to prevent warm air from entering the interior, and to prevent the cold present therein from escaping to the outside when the refrigeration appliance is closed. Due to the temperature difference between the environment and the interior of the refrigeration appliance, the warm air that has entered the interior of the refrigeration appliance after opening the door is cooled once the door is closed, causing a decrease in the volume of the air, as a result of which a vacuum develops in the interior of the refrigeration appliance and presses the door against the body with a force increased by the ambient air pressure. As a result of the door-closing force increased in this manner, the door may be impossible to open or may be openable only with substantial force, especially with increasing size of the refrigeration appliances.

In order to overcome such difficulties, various approaches have already been proposed for facilitating or performing the opening movement of the door of the refrigeration appliance, and thus help overcome the vacuum developing inside the refrigeration appliance.

For example, German Patent Application DE 10 2006 061 083 A1 describes a refrigeration appliance having a body whose interior can be closed by a door. A seal disposed between the door and the body serves in the manner described above to prevent warm air from entering the interior, and to prevent the cold present therein from escaping to the outside when the refrigeration appliance is closed. Moreover, the refrigeration appliance design presented in DE 10 2006 061 083 A1 has a control unit used for actuating an opening mechanism acting on the door. The control signal needed for this purpose is generated by at least one motion sensor which generally is capable of sensing movements of the door and of outputting in response thereto a signal to the control unit, this signal being usable for actuating the opening mechanism.

Also described is a pressure sensor that senses the pressure in the interior, which changes slightly in response to movement of the door. Such pressure variations in the interior arise, for example, when a pressure force or a pulling force is exerted on the door. This movement of the door is identified as an opening request and triggers a signal for actuating the opening mechanism.

German Patent Application DE 10 2006 061 083 A1 further describes a plunger forming part of the opening mechanism, which, in connection with a coil and a permanent magnet, serves to generate a voltage, and thus an inductive signal. In other words, different sensors are mentioned which are always used to convert a movement of the door into a control signal of the opening mechanism.

Further, DE 20 2000 011 427 U1 describes in general terms a trigger sensor having a force sensor which, according to the disclosure of the document, is used to actuate an opening mechanism.

Force sensors, in particular, have a very short measurement travel, which results in the disadvantage of having to initially adjust or zero such a sensor after installation thereof. Manufacturing and fitting tolerances between corresponding components of the refrigeration appliance can thereby be compensated for within certain limits. Such tolerances could otherwise negatively affect the measurement result. Such an adjustment operation alone is not particularly complex, but what adds to it is that the above-described vacuum developing in the interior of the refrigeration appliance may change the initial setting of the measurement travel of the sensor, requiring it to be readjusted until the selected setpoint is reached again. This is because the vacuum changes in response to varying environmental conditions, or because the adjustment of the door joints changes due to wear. Consequently, in the constructions known heretofore, the arising tolerance deviations lead to inaccuracies in the acquisition of measurement values, and also in the subsequent signal processing, which in turn may result in delayed or premature response of the opening mechanism.

SUMMARY

A refrigeration appliance includes a body having an interior sealed by a closeable door by a seal disposed between the door and the body, and at least one control unit for actuating an opening mechanism acting on the door, whose control signal, which triggers the opening of the door, is configured to be generated by at least one sensor cooperating with a plunger, wherein the plunger has a contact surface for engagement of the sensor, and the plunger is supported in a passage of the door or of the body so that it is configured to be movable, together with the sensor engaged against the contact surface, in an axial longitudinal direction of the plunger and against a force of a spring element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
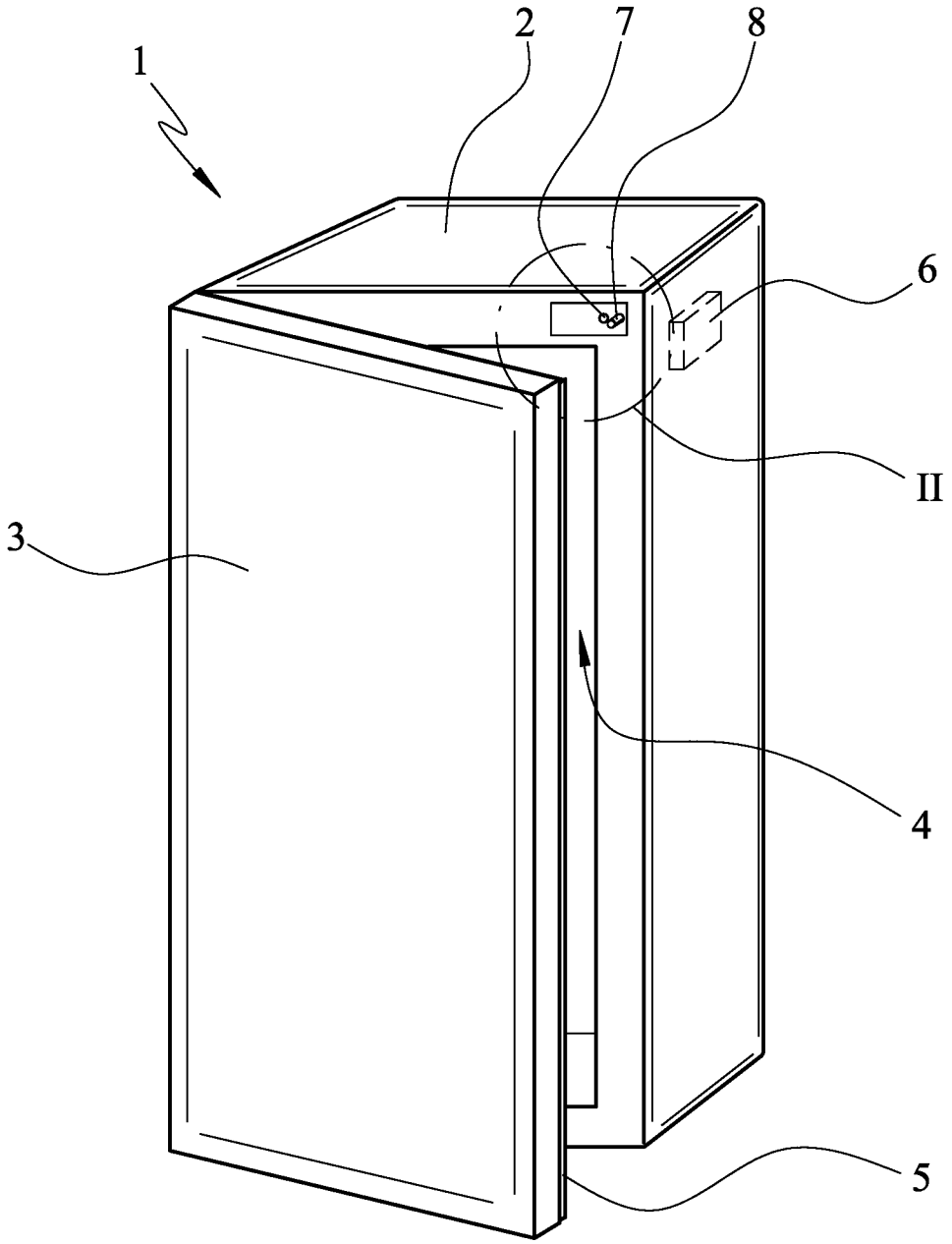
FIG. 1 is a perspective view of an exemplary refrigeration appliance equipped with an opening mechanism.

A refrigeration appliance including a body having an interior which is sealed by a closeable door, for which purpose a seal is disposed between the door and the body, and further including at least one control unit for actuating an opening mechanism acting on the door, whose control signal, which triggers the opening of the door, is generatable by at least one sensor cooperating with a plunger, is improved, according to the present invention, in that the plunger has a contact surface for engagement of the sensor, and in that the plunger is supported in a passage of the door or of the body in such a way that it is movable, together with the sensor engaged against this contact surface, in the axial longitudinal direction of the plunger and against the force of a spring element.

In addition to being simple to implement, another advantage achievable by the present invention is that it completely eliminates the need to later correct the initial adjustment of the sensor, which heretofore would become necessary, for example, due to the vacuum that develops in the interior of the refrigeration appliance and which is subject to variations as a function of varying environmental conditions. In accordance with the present invention, a spring element is used which increases the measurement travel of the sensor in a simple manner. The special feature in this connection is that the spring element urges the sensor into engagement against the plunger, thereby ensuring permanent contact between the sensor and the plunger. The spring follows any movement of the plunger, which has a relatively long free travel, thereby preventing separation between the sensor and the plunger.

It has proved advantageous that the present invention enables very accurate measurements to be made by the sensor within the entire expected range of manufacturing and fitting tolerances. This results in particular from the increase in the measurement travel of the sensor by means of the spring element.

After the sensor is mounted in the refrigeration appliance, first a measurement value for the rest state is acquired with the aid of the sensor. This is followed by zeroing of the sensor, which is performed in the control unit or in peripheral devices provided for this purpose, using suitable software. Moreover, due to the increase in the measurement travel of the sensor, which is achieved by the spring element, it is possible to ensure that the sensor does not need to be readjusted or newly adjusted, even if the environmental conditions and/or the vacuum in the refrigeration appliance should change, or if wear should occur on the door joints.

In accordance with a first embodiment of the present invention, it is additionally proposed that the contact surface of the plunger that contacts the sensor have a spheroid geometry. The spheroid geometry of the contact surface of the plunger has the decisive advantage that the contact surface is always centered on the sensor, regardless of external conditions. In addition, the punctiform contact area with the sensor created as a result of the spheroid geometry decidedly improves the measurement accuracy, so that the parameter to be measured, such as, for example, force, can only be introduced in the axial direction, thereby ruling out erroneous measurements.

According to another proposal of the present invention, the spring element is a helical compression spring. Advantageously, this compression spring is disposed coaxially with the plunger. Such a component is commercially available, and thus provides a simple and therefore low-cost solution for the present application. Moreover, the specific spring characteristics of such compression springs are known and can be accurately determined for the intended application, which also allows for accurate prediction of expected measurement results.

In an embodiment of the present invention, in order to improve the protection of the sensor, the sensor is received in a free space of the plunger. With this construction, the entire sensor unit composed of the sensor, the plunger and the spring element can be made very compact and adapted to occupy little space in the refrigeration appliance. Consequently, this also facilitates installation into the refrigeration appliance.

If, in addition, the sensor is disposed on a floatingly mounted printed circuit board, this has the positive effect that the printed circuit board can be pressed against the plunger by the spring element, and that the sensor thus remains in permanent contact with the plunger in this manner as well. Thus, an improved pressure surface is provided for the spring element. Moreover, the floating mounting of the printed circuit board and thus of the sensor disposed thereon by means of the spring element makes it possible to compensate for movements which occur in response to opening and/or closing of the door. This provides a simple way to avoid any potential negative effects on the measurement results. Another positive aspect of disposing the sensor on the printed circuit board results from the fact that the printed circuit board may contain all electronic components and circuits required to implement signal conditioning. Thus, this solution, too, contributes to a most compact construction of the sensor unit, which, in this case, includes also the printed circuit board.

In one specific variant of an embodiment of such a printed circuit board, the printed circuit board has circular segment-shaped cutouts surrounding the sensor to receive corresponding ribs formed on the plunger and surrounding the free space thereof. In this manner, the plunger can be received and supported in the printed circuit board. In addition, by suitable measures, the plunger can also be axially guided in the printed circuit board, which thus has several functions.

In accordance with a further proposal of the present invention, the sensor is one which operates based on the piezoelectric effect. This means that the sensor used may be a piezoelectric sensor, a piezoresistive sensor, or a magnetoelastic sensor.

In the case of the piezoelectric sensors preferably used here, a pressure force applied to the sensor generates an electrical voltage which may be further processed as a signal.

In contrast, in piezoresistive sensors, the electrical resistance is used as a signal. Such a sensor is a pressure sensor, in which a diaphragm is flexed in response to a mechanical pressure difference between one side and the opposite side, as a result of which the electrical resistance changes. Magnetoelastic sensors, in contrast, are based on the principle of electrical inductance, which changes under the action of a pressure force exerted on the sensor.

In more general terms, the sensor used in accordance with the present invention is a force sensor which may operate based on one of the aforementioned principles.

With regard to the construction of the plunger, it is advantageous for it to have an abutment flange on the interior side of the passage provided in the door or in the body. In this simple manner, the plunger is secured or fixed in the passage, while also ensuring that the plunger remains in permanent contact with the sensor. Thus, the plunger is installed from the interior side of the door or body by inserting it into the passage.

In another embodiment of the present invention, the passage for the plunger is configured as a bearing sleeve on the interior side of the door or of the body. In the first instance, this solution seems to be banal, but it has the decisive advantage that the bearing sleeve ensures linear guidance and lateral stabilization of the plunger. In other words, the plunger is optimally guided and supported in the refrigeration appliance with the aid of the bearing sleeve. Furthermore, the inner surface of the bearing sleeve may be provided with an additional, friction-reduced coating, or be entirely made from slippery material. It is also within the scope of the present invention to form the bearing sleeve integrally as one piece on or with the interior side of the passage.

Preferably, the force-travel curve of the spring element is matched to the measurement range of the sensor. The sensor has a measurement range which includes both the sensor's measurement range and the action of the spring element.

Furthermore, in the refrigeration appliance according to the present invention, an abutment surface corresponding to the underside of the plunger is provided to mechanically limit the deformability of the spring element, and thus to protect the sensor from overloading. In other words, the range of motion of the plunger is limited, because it has, on the one hand, an abutment surface on its underside, which corresponds to the abutment surface of the refrigeration appliance, and, on the other hand, the aforedescribed abutment flange.

The present invention will be described below in more detail with reference to the accompanying drawings. The exemplary embodiment shown is merely intended to illustrate the principle of the present invention, but should not be construed as limiting it to the variant shown.

Identical or similar components are denoted by the same reference numerals throughout. For the sake of illustrating the operation of the present invention, the figures are greatly simplified schematic views in which components not essential to the invention have been omitted. However, this does not mean that such components are not present in an approach in accordance with the present invention.

FIG. 1 shows in perspective view an exemplary refrigeration appliance 1, which is essentially composed of a body 2 and a door 3 closing the same. Moreover, body 2 has an interior 4, which is closed by door 3. In the example shown in FIG. 1, a peripheral seal 5 is provided on the interior side of door 3 facing body 2 to prevent warmed air from entering interior 4 of refrigeration appliance 1, and cooled air from escaping from interior 4. When door 3 is closed, peripheral seal 5 engages the corresponding surface of body 2. Interior 4 of refrigeration appliance 1 serves in known manner to receive objects or products to be cooled.

Moreover, a control unit 6 (sketched only schematically in FIG. 1) serves to process a signal generated by a sensor 9 of refrigeration appliance 1 and to actuate an opening mechanism 7 by this signal. In the present case, signal generation is accomplished using a plunger 8 which is activatable by door 3 and whose intent will be discussed in greater detail below.

Figure 2:
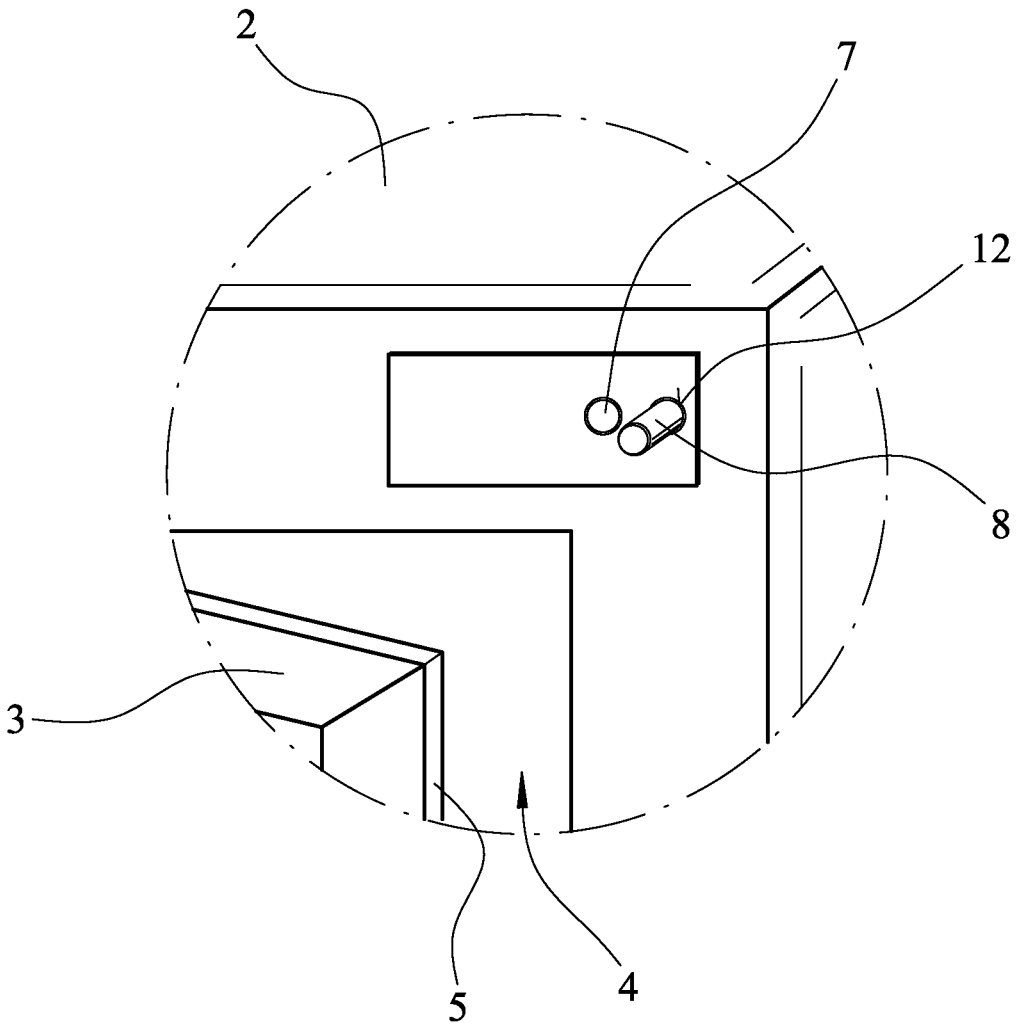
FIG. 2 is an enlarged view of detail II of FIG. 1.

FIG. 2 shows an enlarged view of detail II of FIG. 1. In this view, it becomes clear that opening mechanism 7 is built as a unit with the sensor unit, of which only plunger 8 is visible in FIG. 2. This plunger 8 extends through a passage 12 in a direction perpendicular to the surface of body 2, from which it projects a certain distance. In FIG. 2, only a bore of opening mechanism 7 is shown. Upon activation of opening mechanism 7, a pin comes out of this bore and is pressed against the surface of door 3 to open the same.

The unit formed by opening mechanism 7 and the sensor unit may, of course, also be installed in door 3. It is also within the scope of the present invention to provide the sensor unit and opening mechanism 7 separately from one another.

However, the shown embodiment as a unit has the important advantage that it can be installed in a pocket of refrigeration appliance 1, such as is used also for installation of a hinge. This allows refrigeration appliance 1 to be standardized such that door 3 can be hinged both on the left side and on the right side. Accordingly, the unit formed by opening mechanism 7 and the sensor unit can be installed in the remaining pocket on the strike side of the door, which is not needed for the hinge.

Figure 3:
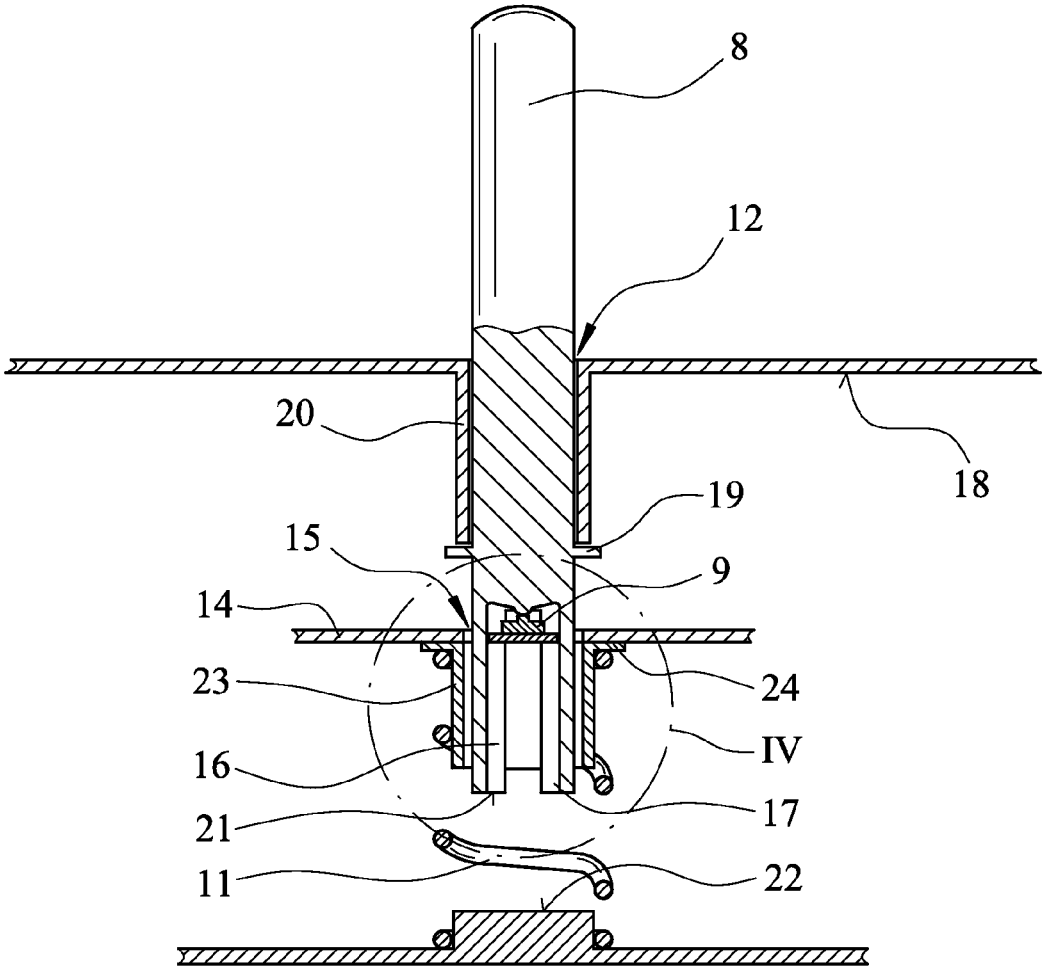
FIG. 3 is a partial sectional view showing a sensor unit in the installed condition.
Figure 4:
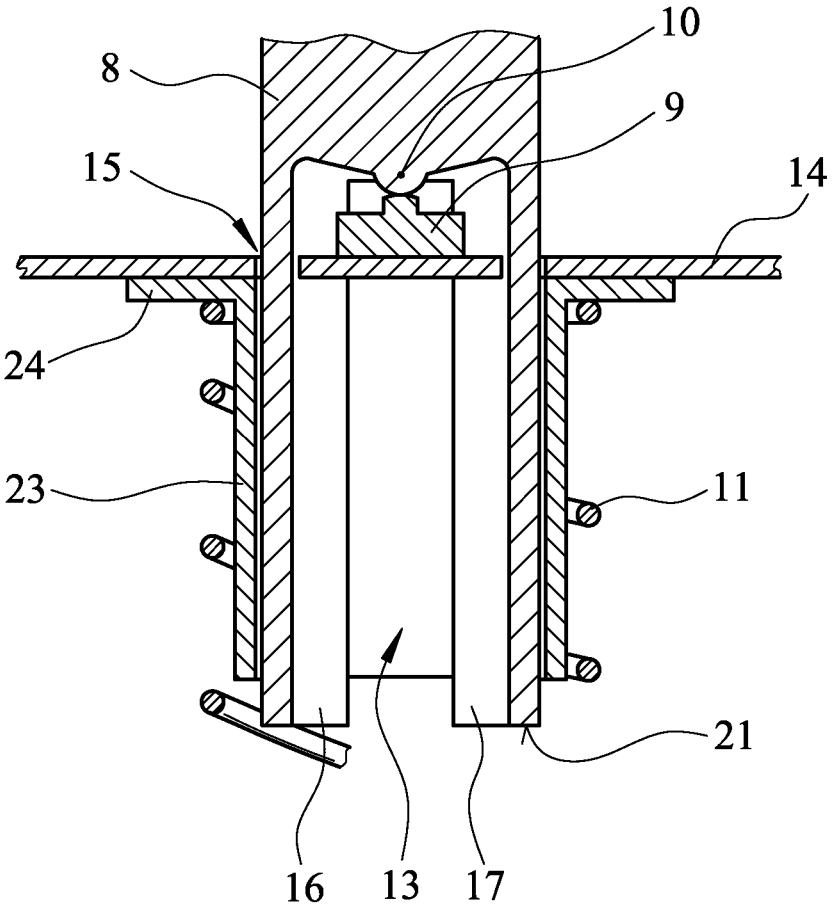
FIG. 4 is an enlarged view of detail IV of FIG. 3.

FIG. 3 shows in partial sectional view a sensor unit in the installed condition, while FIG. 4 shows an enlarged view of detail IV of FIG. 3, which will be described below in connection therewith. Here, the sensor unit is composed of a plunger 8 which, in the example shown, protrudes with a portion of its length through a passage 12 from the surface of body 2 of refrigeration appliance 1. For improved guidance and lateral stabilization of plunger 8, a bearing sleeve 20 is configured on interior side 18 of the surface of body 2. An abutment flange 19 provided on plunger 8 rests against bearing sleeve 20 in the axial direction of plunger 8, thus preventing plunger 8 from releasing itself from the unit. Moreover, plunger 8 has formed on its underside two ribs 16 and 17 which extend through a printed circuit board 14 having matching cutouts 15. Furthermore, below printed circuit board 14, plunger 8 is received in a guide sleeve 23, which further improves guidance and support thereof. A spring element 11 bears against a circumferential collar 24 formed on guide sleeve 23, the other end of the spring element coming to rest on a flange-shaped abutment surface 22. The spring element 11 used here is a compression-type helical spring of simple construction. Abutment surface 22 provides here a mechanical limit to the distance that may be traveled by plunger 8 against the force of spring element 11. Plunger 8 also has a abutment surface on its underside 21 corresponding to abutment surface 22. Due to the ribs 16, 17 provided on the underside of plunger 8, a free space is created in this area of plunger 8, a sensor 9 in the form of a force sensor being disposed in this free space. This special design of the plunger allows the illustrated unit to be made very compact. As can be seen particularly in the view of FIG. 4, sensor 9 has an approximately central, rounded contact surface which is in permanent contact with a corresponding contact surface 10 of plunger 8 under the action of spring element 11. Contact surface 10 of plunger 8 has a spheroid geometry, which means that it is shaped here as a spherical segment. In FIGS. 3 and 4, the sensor unit is shown in the position when door 3 is open. When door 3 is closed, plunger 8 recedes a certain distance against the force of spring element 11, as a result of which sensor 9 is acted upon by a nominal load, which is determined as a setpoint with the aid of control unit 6. Based on this setpoint, any change in the movement of plunger 8 has a direct effect on sensor 9, so that sensor 9 detects movements of plunger 8 as a signal deviating from the setpoint, and forwards the same to control unit 6, which thereupon transmits a control signal to opening mechanism 7, thereby activating the same.

Figure 5:
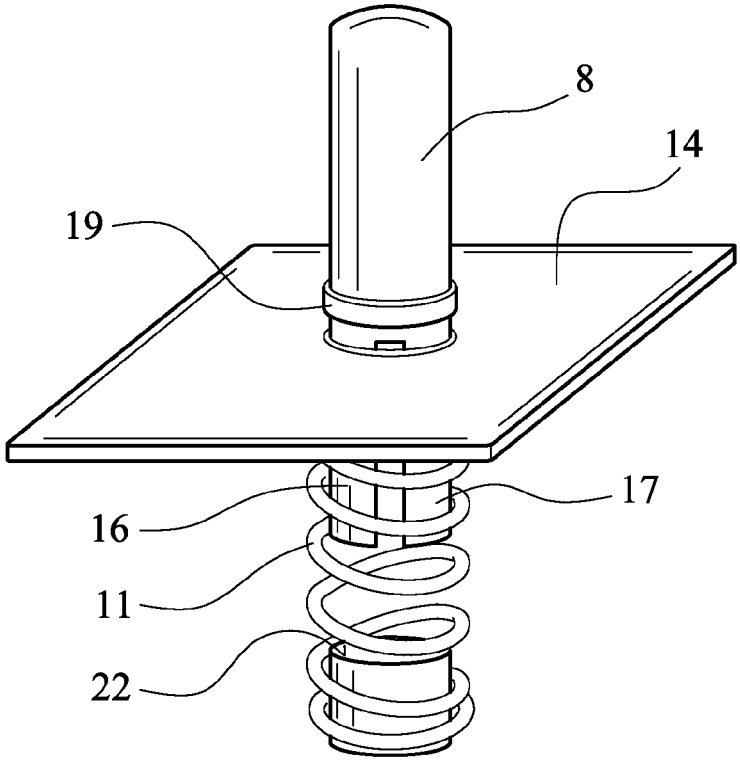
FIG. 5 is a three-dimensional view of an exemplary sensor unit with a printed circuit board.

In FIG. 5, the sensor unit is shown as an isolated assembly in a three-dimensional view. The sensor unit is composed of plunger 8 with sensor 9 received therein, printed circuit board 14, and spring element 11. Above printed circuit board 14, plunger 8 has formed thereon a circumferential abutment flange 19 which, when spring element 11 is completely relaxed, comes to rest on the underside of bearing sleeve 20 of body 2, thus captively securing plunger 8.

Figure 6:
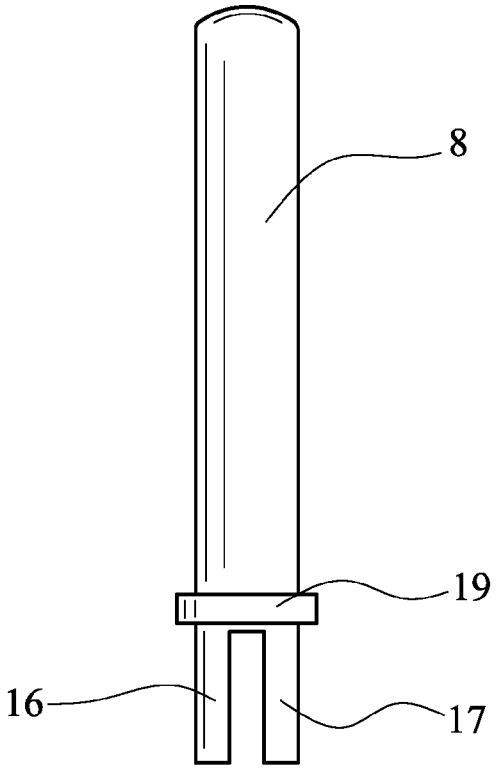
FIG. 6 is a view showing a plunger as a separate part.

FIG. 6 shows one possible embodiment of plunger 8, which has formed on its underside two ribs 16, 17, between which the free space 13 suitable to receive sensor 9 is formed.

Figure 7:
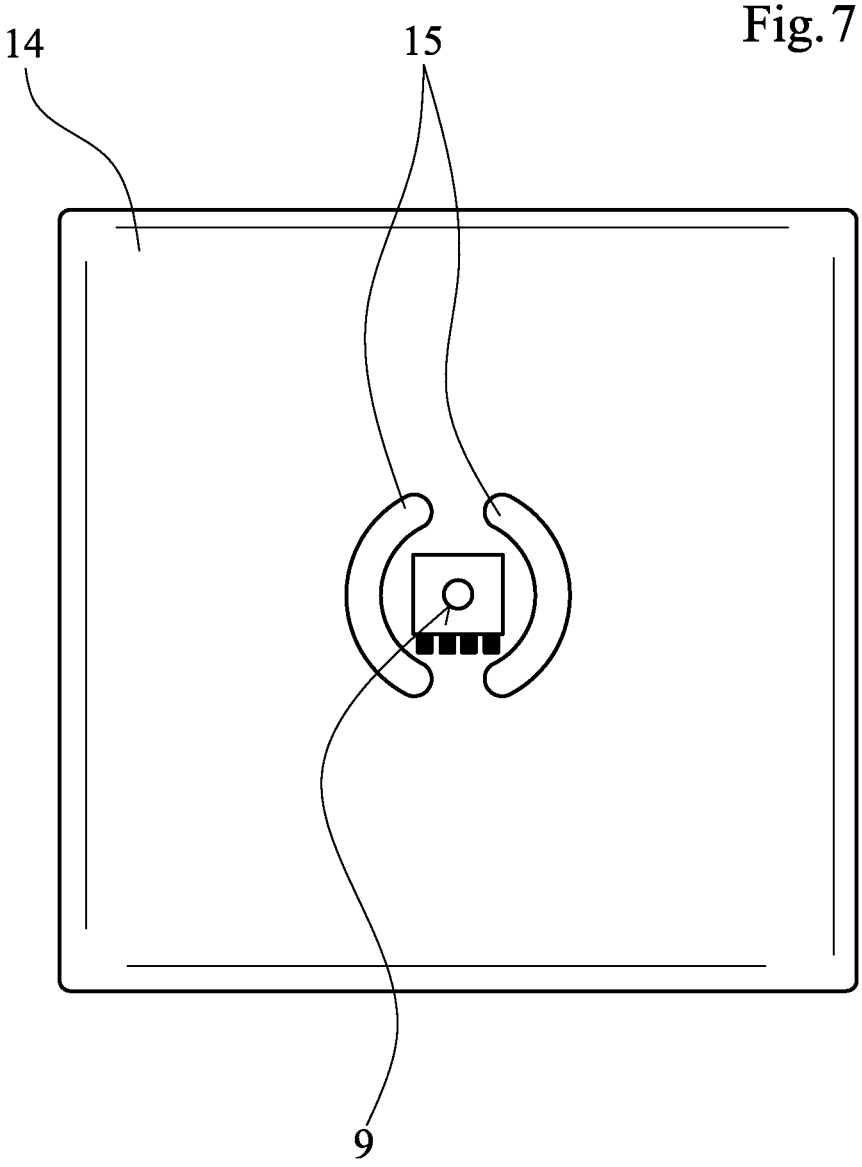
FIG. 7 is an isolated top view showing a printed circuit board as a separate part.

Finally, FIG. 7 shows a top view of printed circuit board 14. In this view, it can be seen how cutouts 15 are configured to enable ribs 16, 17 of plunger 8 to extend therethrough. Cutouts 15 are approximately semicircular in shape. Sensor 9 is disposed centrally between cutouts 15 and is provided in its central region with a raised surface corresponding to contact surface 10 of plunger 8. This makes it possible to achieve a point contact between contact surface 10 of plunger 8 and sensor 9, which decidedly improves the introduction of force into sensor 9, and thus the measurement accuracy of sensor 9.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 refrigeration appliance
2 body
3 door
4 interior
5 seal
6 control unit
7 opening mechanism
8 plunger
9 sensor
10 contact surface
11 spring element
12 passage
13 free space
14 printed circuit board
15 cutouts
16 rib
17 rib
18 interior side
19 abutment flange
20 bearing sleeve
21 underside
22 abutment surface
23 guide sleeve
24 collar

What is claimed is:

1. A refrigeration appliance comprising:

a body having an interior sealed by a closable door by a seal disposed between the door and the body; and at least one control unit for actuating an opening mechanism acting on the door, whose control signal, which triggers the opening of the door, is configured to be generated by at least one sensor cooperating with a plunger, wherein the plunger has a contact surface for engagement of the sensor, and the plunger is supported in a passage of the door or of the body so that it is configured to be movable, together with the sensor engaged against the contact surface, in an axial longitudinal direction of the plunger and against a force of a spring element, wherein the sensor is disposed on a floatingly mounted printed circuit board.

2. The refrigeration appliance of claim 1, wherein the contact surface of the plunger that contacts the sensor has a spheroid geometry.

3. The refrigeration appliance of claim 1, wherein the spring element is a helical compression spring disposed coaxially with the plunger.

4. The refrigeration appliance of claim 1, wherein the sensor is received in a free space of the plunger.

5. The refrigeration appliance of claim 1, wherein the printed circuit board has circular segment-shaped cutouts surrounding the sensor to receive corresponding ribs formed on the plunger and surrounding the free space thereof.

6. The refrigeration appliance of claim 1, wherein the sensor operates based on a piezoelectric effect.

7. The refrigeration appliance of claim 1, wherein the sensor is a force sensor.

8. The refrigeration appliance of claim 1, wherein the plunger has an abutment flange on an interior side of the passage provided in the door or in the body.

9. The refrigeration appliance of claim 1, wherein the passage for the plunger is configured as a bearing sleeve on an interior side of the door or of the body.

10. The refrigeration appliance of claim 1, wherein a force-travel curve of the spring element corresponds to a measurement range of the sensor, and the sensor has a measurement range which includes both the sensor's measurement range and the action of the spring element.

11. The refrigeration appliance of claim 1, wherein a measurement travel of the sensor is increased by the spring element.

12. The refrigeration appliance of claim 1, wherein in the refrigeration appliance, an abutment surface corresponding to an underside of the plunger is provided to mechanically limit the deformability of the spring element so as to protect the sensor from overloading.

* * * * *